United States Patent [19]

Olsson

[11] Patent Number: 4,741,099

[45] Date of Patent: May 3, 1988

[54] APPARATUS FOR ACCURATELY TERMINATING AN ELECTRICAL CONNECTOR WITH A MULTICONDUCTOR CABLE

[75] Inventor: Billy E. Olsson, New Cumberland, Pa.

[73] Assignee: AMP Incorporated, Harrisburg, Pa.

[21] Appl. No.: 14,945

[22] Filed: Feb. 17, 1987

[51] Int. Cl.[4] ..... H01R 43/01

[52] U.S. Cl. ..... 29/749; 29/753; 29/866

[58] Field of Search ..... 29/749, 753, 865, 866, 29/750–752, 754

[56] References Cited

U.S. PATENT DOCUMENTS

| | | | |
|---|---|---|---|
| 4,046,045 | 9/1977 | Stevens | 83/620 |
| 4,077,695 | 3/1978 | Bakermans | 339/176 MF |
| 4,091,531 | 5/1978 | Grubb et al. | 29/753 X |
| 4,148,130 | 4/1979 | Stauffer et al. | 29/566.3 |
| 4,228,709 | 10/1980 | Guzay, Jr. et al. | 83/620 |
| 4,597,158 | 7/1986 | Hirokawa et al. | 29/566.3 |

FOREIGN PATENT DOCUMENTS 2165778A 4/1986 United Kingdom .

OTHER PUBLICATIONS

Allied Signal, "Amphenol High Density 25 mil IDC Connectors", 845 Series.

*Primary Examiner*—Gil Weidenfeld

*Attorney, Agent, or Firm*—Bruce J. Wolstoncroft

[57] ABSTRACT

An apparatus (60) is disclosed for accurately aligning and terminating conductors (4) of a flat multiconductor cable (2) to terminals (26) of a connector (18). This apparatus (60) is particularly suited for use with cables (2) that have closely spaced conductors (4). To ensure proper termination, the apparatus (60) forces the individual conductors (4) into respective grooves (38) of the cover (22) of the connector (18). These grooves (38) are molded in the cover (22) and are therefore, more accurately positioned than the extruded conductors (4). With the conductors (4) maintained in their resepctive grooves (38), the termination process is completed. This ensures that a positive electrical connection is effected between the connector (18) and the cable (2), even when the cable (2) has a nominal spacing between adjacent conductors (4) 0.025 inches or less.

21 Claims, 8 Drawing Sheets

APPARATUS FOR ACCURATELY TERMINATING AN ELECTRICAL CONNECTOR WITH A MULTICONDUCTOR CABLE

FIELD OF THE INVENTION

The invention relates to an apparatus for terminating an electrical connector onto a flat ribbon cable. In particular, the apparatus is used to terminate closely spaced terminals of the connector to closely spaced conductors of the cable.

BACKGROUND OF THE INVENTION

A widely used type of electrical cable comprises a plurality of spaced-apart parallel coplanar conductors which are embedded in plastic insulation material. Electrical connection to the conductors in the cable is made by installing a multi contact electrical connector on the cable. The connector has a cable-receiving face with terminals extending therefrom. The terminals have slots that are positioned to receive the conductors of the cable therein. The electrical connection is effected as the terminals are forced through the cable, causing the conductors to enter the slots and establish electrical contact therewith. Thus, the mere installation of the connector on the cable also brings about an electrical connection between the terminals in the connector and the corresponding respective conductors in the cable.

Problems can arise when the connector is installed on the cable because the cable cannot be manufactured to the same precise dimensional standards as can the connector. Consequently, spacing between adjacent conductors may vary within given tolerance limits. U.S. Pat. No. 4,077,695 explains this problem in detail and presents a solution for certain types of flat cable, particularly cable of the type in which each conductor is surrounded by a substantially cylindrical insulating sheath and each insulating sheath is connected to the next adjacent insulating sheath by a thin flexible web of plastic material. At the time the above identified patent was written, the minimum spacing between adjacent conductors in a flat conductor cable was 0.05 (1.27 mm) inches and it was, therefore, feasible to provide the thin connecting web between adjacent conducting sheaths in the cable, as taught by the referenced patent.

In more recent times, cable suppliers have begun to produce flat multiconductor cable in which adjacent conductors are spaced apart by only 0.025 inches (0.63 mm). With this tight spacing, it is impractical to manufacture the cable with a thin web as explained and shown in the above identified application. Because of the close spacing of the conductors, it is necessary that the insulating material extend as an almost continuous mass with the conductors embedded in the insulating material. Consequently, the thickness of the insulating material varies only slightly across the width of the cable. Furthermore, the manufacturing difficulties of producing this relatively fine cable results in wide tolerances in the dimensions between the outside conductors of the cable, referred to as the span tolerance of the cable. As a result, problems can be encountered when a connector is installed on a cable with closely spaced conductors, some of the conductors in the cable may not line up with the proper terminals in the connector as the installation occurs. Consequently, shorting between adjacent conductors can be caused if a single terminal in the connector contacts two conductors in the cable, resulting in an ineffective electrical connection between the terminals of the connector and the conductors of the cable.

Patent Application Ser. No. 853,072 describes one solution to the problem described above. The closely spaced multiconductor cable is reworked and sized so that a connector can be installed on the reworked portion of the cable. In accordance with application Ser. No. 853, 072, a portion of the flat multiconductor cable is clamped between opposed first and second clamping surfaces. As clamping occurs, at least some of the conductors of the portion of the cable are moved laterally in the conductor plane relative to the conductor axes with accompanying deformation of the plastic insulating material between adjacent conductors. The movement of the conductors causes a reduction in the span tolerance of the portion of the cable, such that when the clamped position is reached, the portion of the cable is accurately positioned. Thereafter, holes are punched between adjacent conductors portion of the cable, thereby providing openings between the conductors and providing the configuration required to allow a connector to be reliably connected to the cable. The portion of the cable is then unclamped and as a result of the operation, the portion of the cable is sized and reworked and the span tolerance is reduced. The problem involved with this type of solution is that the cable must be handled too often. In other words, it would be less time consuming, cheaper, and more effective if the connector could be terminated in one step, without the need to first rework the cable in a separate operation.

SUMMARY OF THE INVENTION

In accordance with one embodiment, the invention comprises an alignment and termination apparatus for accurately aligning and terminating conductors of a flat multiconductor cable to terminals of a connector. The cable comprises a plurality of side-by-side spaced-apart coplanar parallel conductors which are embedded in plastic insulating material and which have axes which define a conductor plane. The cable has parallel side cable edges and oppositely-facing first and second major cable surfaces. Each of the cable surfaces have, in transverse cross section, a series of cylindrical opposed and aligned convex projections. A conductor is centrally located with respect to each pair of opposed projections. The spacing between the axes of adjacent conductors is $d \pm x$ where d is the nominal spacing and x is the spacing tolerance. The span distance between the two outside conductors, which are immediately adjacent to the cable side edges, is $(n-1)d \pm s$ where n is the number of conductors and s is the span tolerance. The span tolerance in such cables is greater or less than the spacing tolerance.

The connector for use with the apparatus has a housing means with terminals extending therefrom and a cover means with accurately positioned grooves thereon. The apparatus for installing the electrical connector on the flat multiconductor cable, has a base plate which has a top and a bottom surface. An opening of the base plate extends from the top surface to the bottom surface. Proximate the base plate, is a yoke portion. The yoke portion is springably mounted to the base plate, such that the yoke portion can move relative to the base plate. The yoke has a top surface and a bottom surface with an opening extending from the top surface to the bottom surface. The opening of the yoke portion and the opening of the base plate are in alignment with each other. A support block is provided in the opening of the base plate. The support block is movable between a first position and a second position, allowing the support block to move into the opening of the yoke portion.

Camming guides are provided by the yoke portion. The camming guides have connector cooperation means provided at respective ends, the respective ends being proximate each other. The camming guides are movable such that the ends containing the connector cooperation means can be moved into and out of the opening of the yoke portion as required.

The camming guides of the apparatus cooperate with the cover to force the conductors of the cable into the grooves of the cover before the terminals of the connector engage the conductors of the cable. This ensures that the terminals and the conductors are accurately aligned as the terminals of the connector are terminated to the conductors of the cable.

In accordance with the method aspect of the invention, a portion of a flat conductor cable is accurately positioned and terminated to terminals of an electrical connector. This is accomplished by aligning a cover member and a housing member of the connector in spaced apart relationship. A cable support means is positioned between the cover member and the housing member. A cable is placed on a surface of the cable support means. With the cover member, the cable, the cable support means, and the housing member in alignment, the cover member is forced toward the cable and the cable support means. The cable support means is held relatively stationary as compared to the cover member, such that as the cover member engages the cable, the force of the cover member causes respective conductors of the cable to be positioned in grooves provided on a surface of the cover member. The conductors are maintained in the grooves by the opposing force of the cable support means. The cover member, with the conductors positioned in the grooves, and the cable support means are then forced toward the housing member, causing terminals of the housing means to pierce insulation of the cable, partially terminating the terminals of the housing member to the cable and to the cover member. The cable support means is subsequently removed and the housing member and the cover member are forced together, causing the terminals of the housing member to fully terminate to the cable and the cover member, thereby ensuring that a positive electrical connection is affected between the connector and the cable.

DETAILED DESCRIPTION OF THE INVENTION

Figure 2:
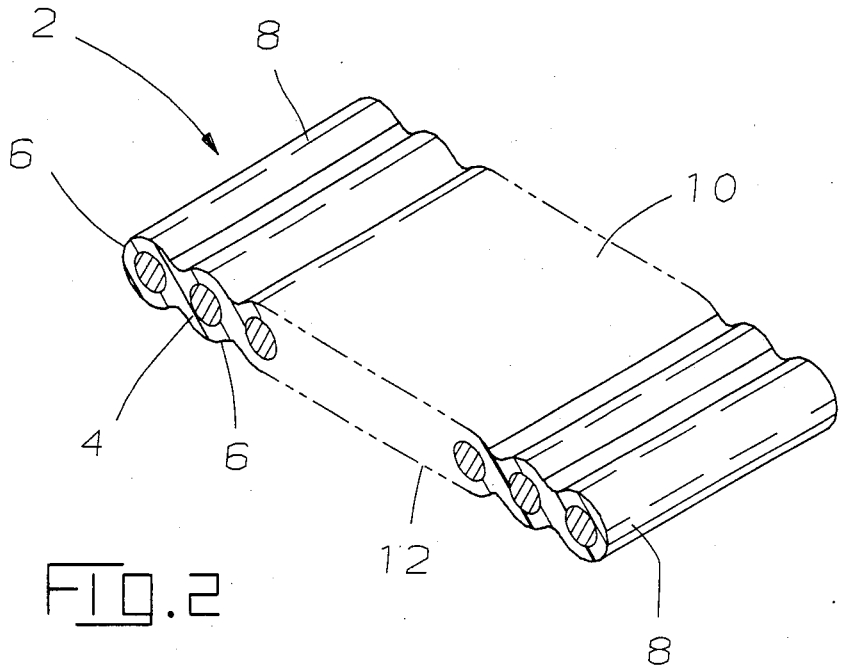
FIG. 2 is an enlarged perspective view of a portion of a flat conductor cable used in the apparatus.

Referring first to FIG. 2, a flat conductor cable 2 comprises a plurality of parallel side-by-side conductors 4 embedded in plastic material 6. Conductors 4 are coplanar and define a conductor plane to which reference will be made below. Cable 2 has parallel side edges 8, an upper major surface 10, and a lower major surface 12.

Figure 3:
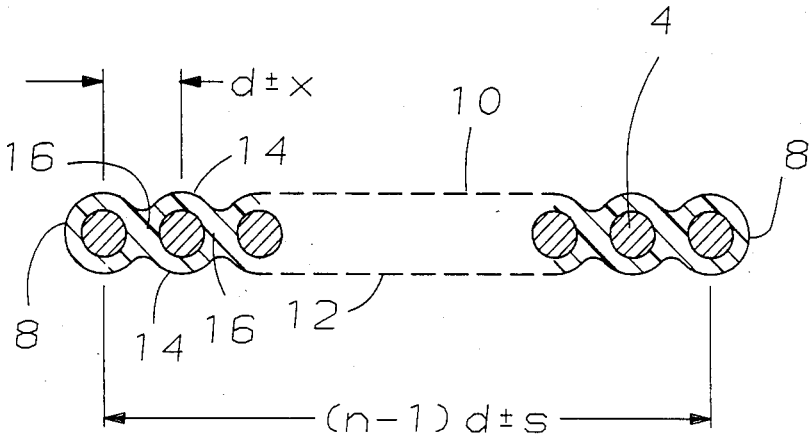
FIG. 3 is an enlarged elevational view of a portion of the cable.

As best shown in FIG. 3, upper and lower surfaces 10, 12 have, in transverse cross section, a series of cylindrical convex projections 14, each projection having a conductor 4 centrally located with respect thereto. Projections 14 on the two surfaces 10, 12 are opposed to, and in alignment with, each other. The type of cable shown has a continuous thick mass insulating material 16. FIG. 3, between adjacent conductors rather than a thin membrane as with some known type of flat cable.

Figure 4:
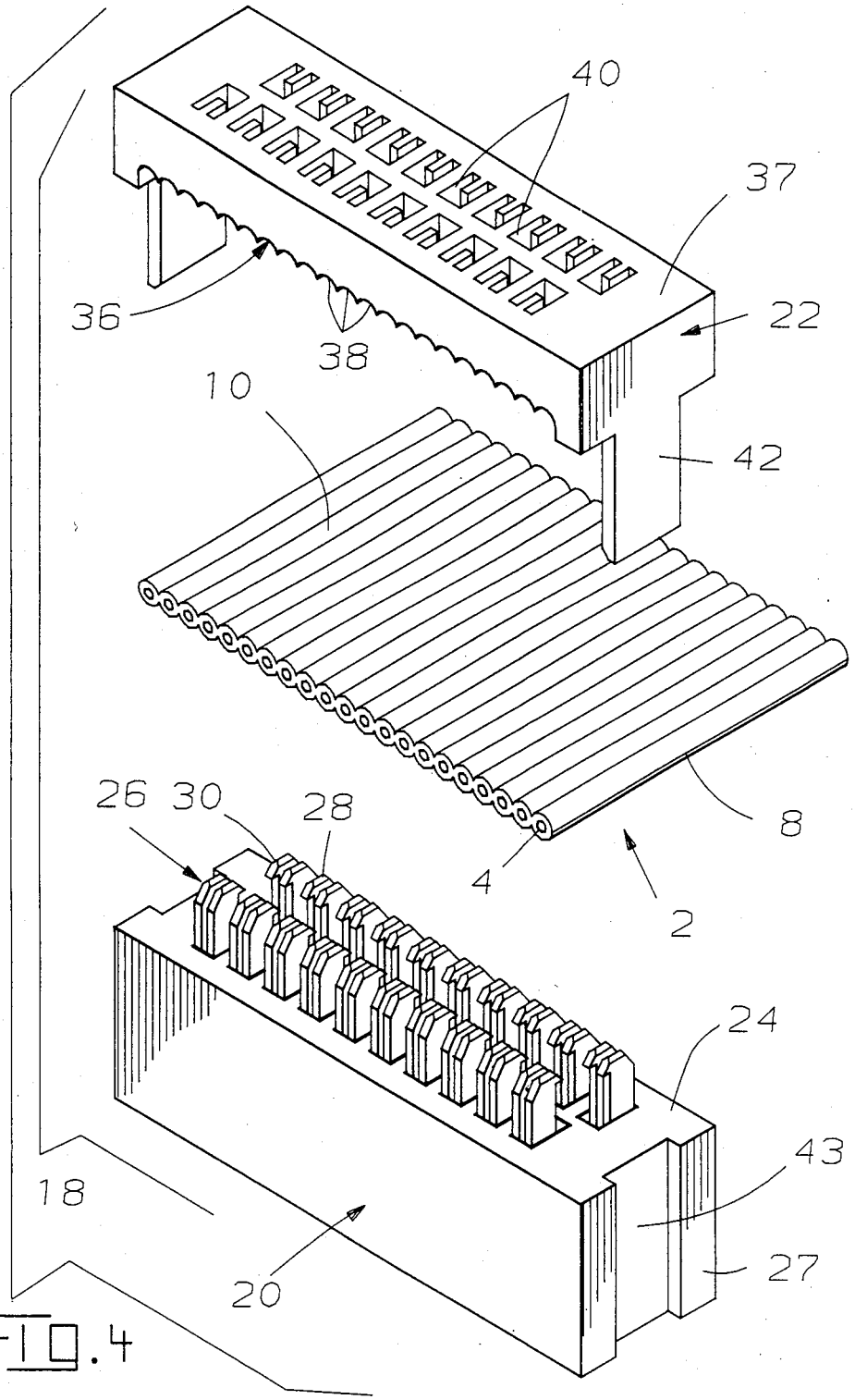
FIG. 4 is a perspective view of a connector of the type used with the flat conductor cables.

FIG. 4 shows a multi contact connector 18 of a type which is installed on cable 2 to establish electrical contact with conductors 4 in cable 2. Connector 18 comprises a generally prismatic housing 20 and a cover 22. Housing 20 has a cable-receiving face 24 which is directed upwardly in FIG. 4. Extending upward from face 24 are terminals 26 which are of the type described fully in U.S. Pat. No. 4,600,259. Terminals 26 are usually arranged in two or more parallel rows which extend between end walls 27 of connector 18. The spacing of terminals 6 is such that terminals 26 of one row are staggered with respect to terminals 26 in the other row. Terminals 26 have insulation piercing free ends 30 which are spaced from cable-receiving face 24 and wire-receiving slots 28 which extend inwardly from free ends 30. Electrical contact is established between connector 18 and cable 2 by forcing a conductor 4 of cable 2 into a slot 28 of terminal 26 of connector 18, such that the opposed surfaces of each slot 28 contacts a respective conductor 4.

Figure 8:
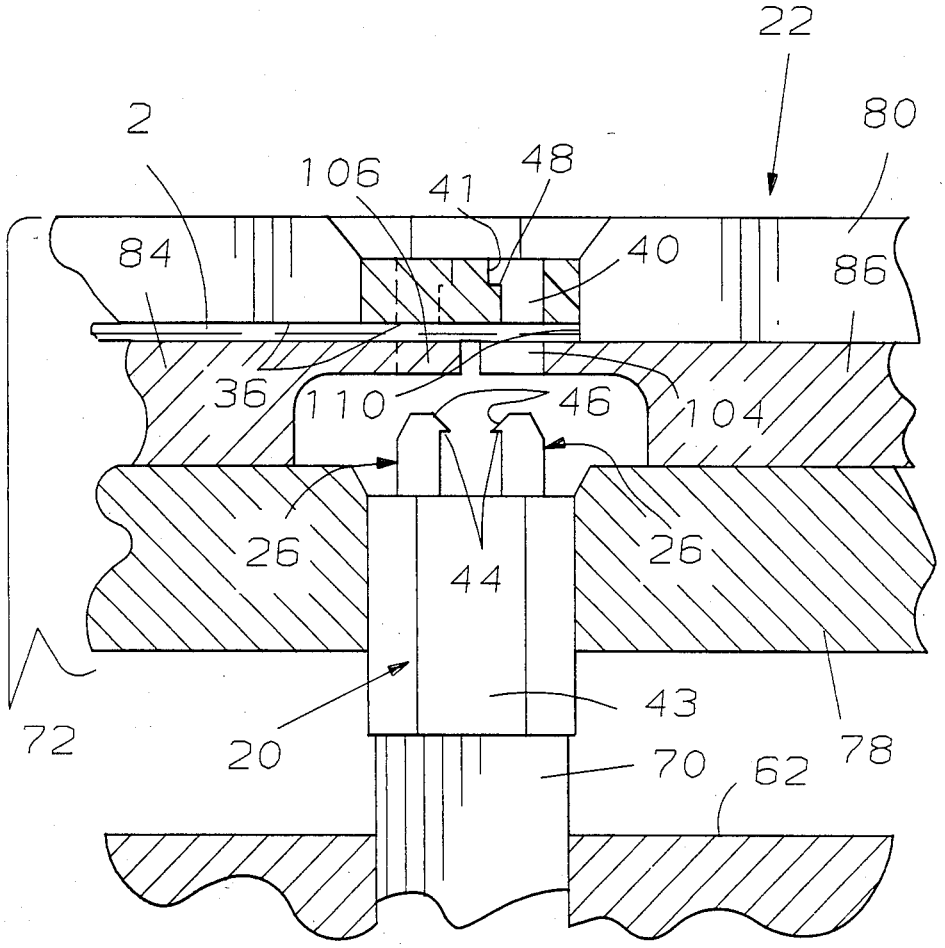
FIG. 8 is an enlarged fragmentary cross sectional view showing the apparatus in an open position.

Cover 22 has a surface 36 which is opposed to cable receiving surface 24 of housing 20. Surface 36 has side-by-side concave depressions 38 positioned therein. These concave depressions 38 have substantially the same radius of curvature as do convex cylindrical projections 14 of cable 2. Consequently, depressions 38 conform to the surface of cable 2. Openings 40 extend through cover 22 so that free ends 30 of terminals 26 can be passed through these openings when connector 18 is installed on cable 2. Openings 40 have recesses 41 provided therein, as shown in FIG. 8. Recesses 41 cooperate with shoulders 44 of barbs 46 which are provided proximate free ends 30 of terminals 26 such that when terminals 26 are fully inserted, barbs 46 are positioned in recesses 41. Shoulders 44 engage walls 48 of recesses 41 to secure terminals 26 to cover 22, ensuring that a positive electrical connection is maintained between all conductors 4 of cable 2 and all terminals 26 of connector 18. Cover 22 is also provided with arms 42 at each end of cover 22, as shown in FIG. 4.

To install connector 18 on cable 2, it is necessary to accurately position conductors 4 of cable 2 with respect to terminals 26 of connector 18. In order to ensure that conductors 4 are properly positioned, projections 14 on upper surface 10 of cable 2 are positioned in depressions 38 of cover 22. Thereafter, cover 22 and housing 20 are assembled to each other in a manner such that terminals 26 move through cable 2 causing individual conductors 4 to move into respective wire-receiving slots 28 of terminals 26.

The assembly procedure briefly described above requires that each of conductors 4 in cable 2 be in substantial alignment with a respective wire-receiving slot 28 of a respective terminal 26. If cable 2 is dimensionally perfect, the installation of connector 18 on cable 2 will proceed as described above. However, all manufactured articles have dimensional tolerances; that is to say the dimensions of the article are not absolute but rather lie within specified limits. Thus, cable 2 may have a nominal center-to-center spacing d between adjacent conductors 4 of 0.05 inches plus or minus a dimensional tolerance x, as shown in FIG. 3. In the case of a cable having conductors on 0.050 centers, this tolerance, x, is commonly about 0.003 inches.

The span of cable 2 is regarded as the distance between the outside conductors, that is conductors 4 which are immediately adjacent to side edges 8, as shown in FIG. 3. The span is equal to $(n-1)d \pm s$ where n is the number of conductors in the cable and s is the span tolerance. The span tolerance s of a cable 2 is greater by a significant amount than the spacing tolerance x for the reason that the variations in the positions of conductors 4 as a result of the spacing tolerance do not always cancel each other out. The manufacturers of cables therefore have establish a span tolerance, s, which is substantially greater than the spacing tolerance x.

The finest or highest density cable presently available (the cable having the closest spacing and the smallest conductors) has a nominal spacing d between adjacent conductors 4 of 0.025 inches (0.63 mm) with a spacing tolerance x of ±0.002 inches. The span tolerance s for this type of cable is ±0.008 inches for a cable having no more than sixty conductors therein and is ±0.015 inches for a cable having over sixty conductors therein. These tolerances are relatively wide and result from the fact that it is impossible to make the cable with a higher degree of dimensional precision.

Figure 10:
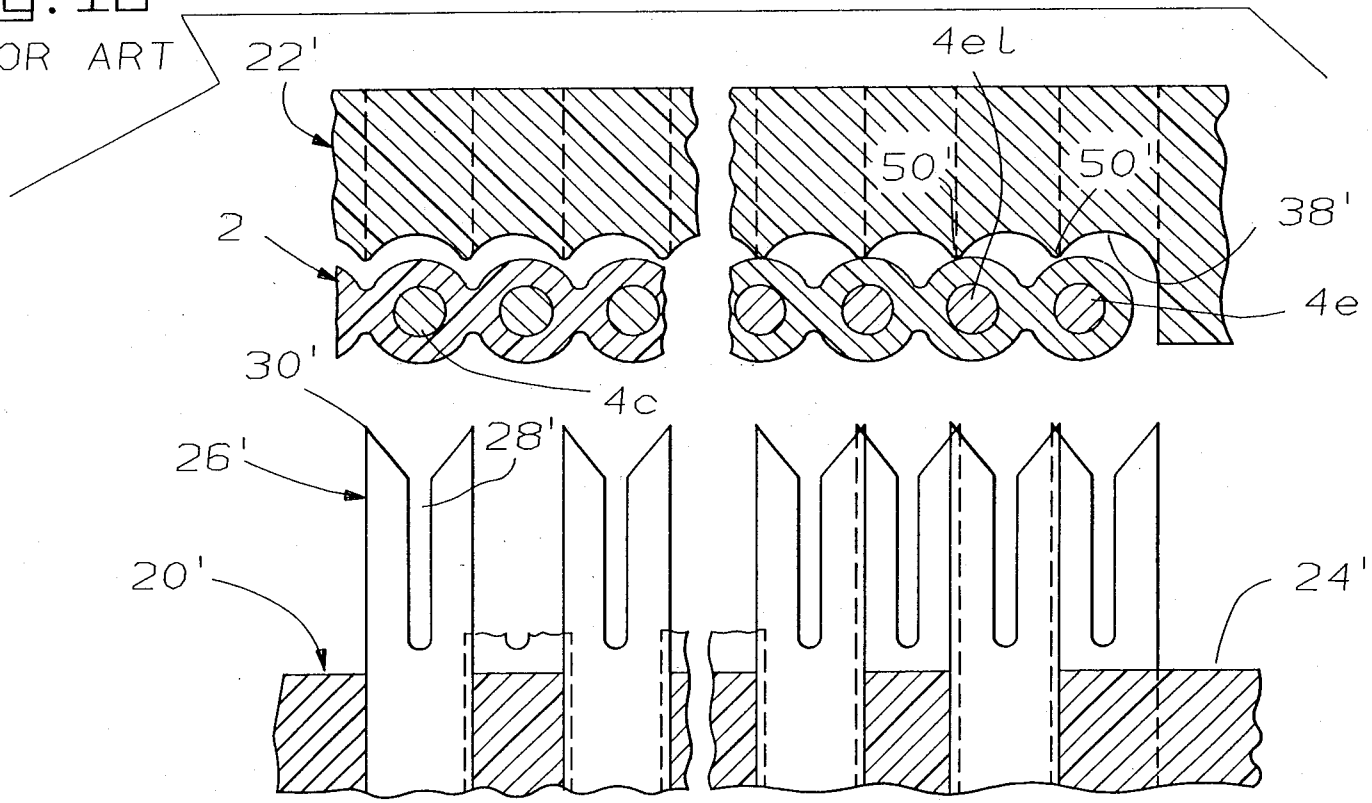
FIG. 10 PRIOR ART
FIG. 10 is a fragmentary view showing a cable which has been manufactured within span tolerance limits but which does not properly align with the terminals of the connector before termination.

FIG. 10 illustrates the problems which can arise when a connector is installed on a cable 2 in accordance with presently known practice. In FIG. 10, it is assumed that cable 2 is within the span tolerance but close to the limit on the minus side. Also in FIG. 10, terminals 26' are of the well-known type which comprise a flat plate-like member having a wire-receiving slot 28' therein. Free ends 30' of terminals 26' are pointed so that terminals 26' will pierce insulation 6 of cable 2 as it must do when the connector housing 20' is moved relatively downwardly from the position shown in FIG. 4.

It can be seen that the conductor 4c in FIG. 10, which is assumed to be the center conductor in cable 2 midway between side edges 8, is in alignment with its respective depression 38'. However, conductor 4e on the left-hand end of cable 2 is not in alignment with its associated depression 38'; rather, the cylindrical projection 14 associated with conductor 4e is against a ridge or cusp 50 which is between two depressions 38'. Similarly, those conductors which are adjacent to conductor 4e are not in alignment with their associated depressions 38' but are rather offset from them. Terminals 26', however, are positioned with a very high degree of precision on connector housing 20' and they are in alignment with their associated depressions 38' on cover member 22'. It should be explained that parts such as molded housings and covers for connectors can be produced with a very high degree of dimensional precision as compared with cables which are manufactured by extruding insulation on wires. The process of manufacturing the cable involves tolerances which, when accumulated, are significant, thereby minimizing the degree of dimensional precision with which the cable can be manufactured.

If connector housing 20' were to be moved relatively upwardly from the position of FIG. 10, it is apparent that the right-hand terminal 26' in FIG. 10 would contact not only the second conductor from the side, conductor 4e1, but will also contact conductor 4e. This would result in the two conductors being shorted or connected to each other which is, of course, a totally unacceptable situation. The possibility of shorting is particularly strong if conductors 4 are stranded wire rather than solid wire.

FIG. 10 thus demonstrates that serious problems can be encountered when conductors 4 of cable 2 are connected to terminals 26' of connector 18' even if cable 2 is within its dimensional tolerance limits, particularly its span tolerance. These problems result from the fact that there is simply a limit to the precision with which such cables 2 can be manufactured.

In accordance with the present invention, an apparatus 60 is provided which first positions conductors 4 of cable 2 in precise alignment relative to terminals 26 of connector housing 20. The terminals 26 are then terminated to the precisely positioned conductors 4 of cable 2, thereby eliminating the possibility of conductors 4 contacting the wrong terminals 26. Consequently, a much more reliable connection is effected between connector 18 and cable 2.

Figure 1:
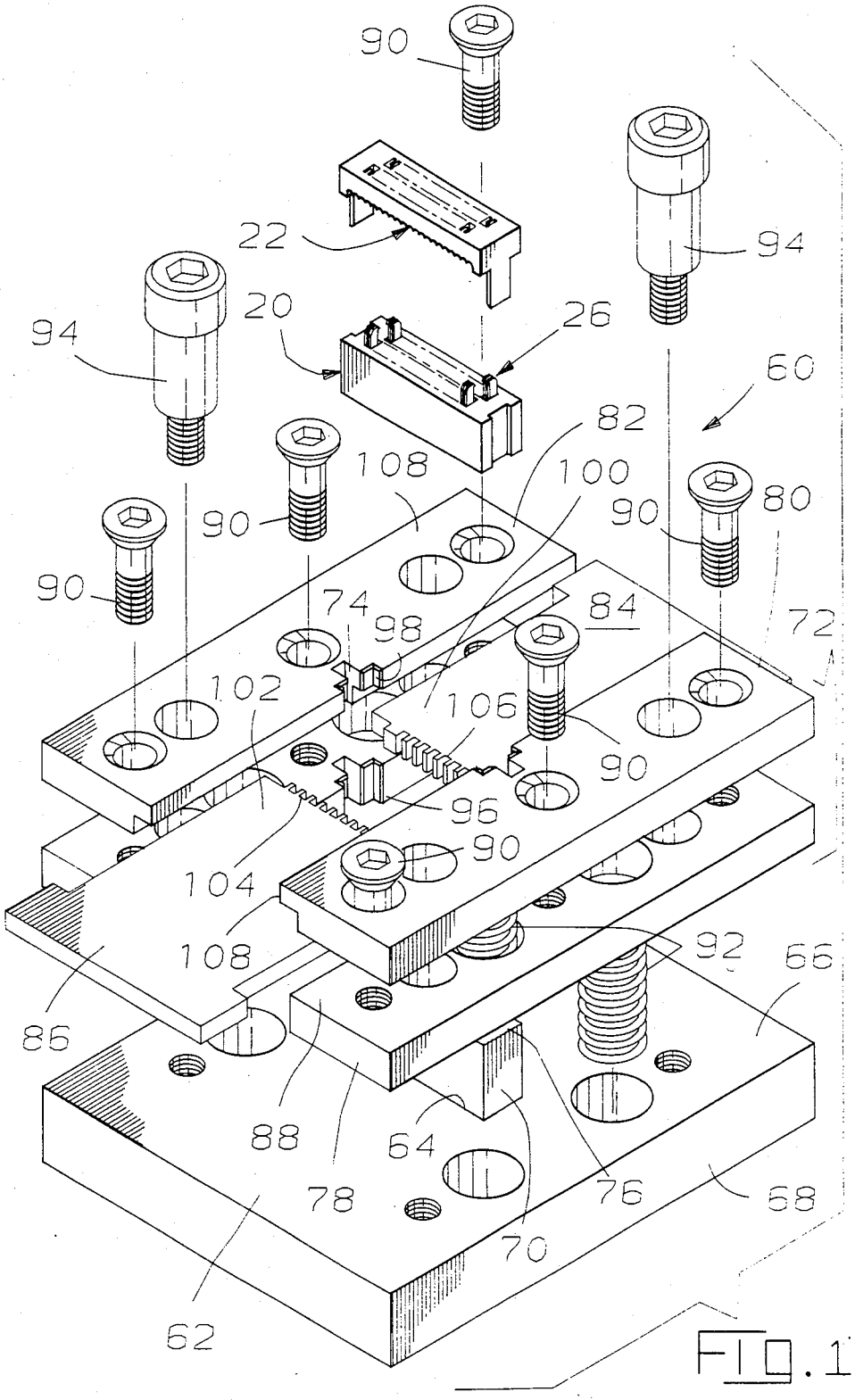
FIG. 1 is a perspective view of an apparatus in accordance with the present invention.

FIGS. 1 and 5–9 show apparatus 60 of the present invention which is used to align and terminate conductors 4 of cable 2 with terminals 26 of connector housing 20. As shown in FIG. 1, apparatus 60 has a rectangular base plate 62 having an opening 64 extending from a top surface 66 to a bottom surface 68. Opening 64 is positioned essentially in the center of base plate 62 and is dimensioned to allow support block 70 to be maintained therein. Support block 70 is independently movable such that it may cooperate with connector housing 20, as will be discussed.

Figure 5:
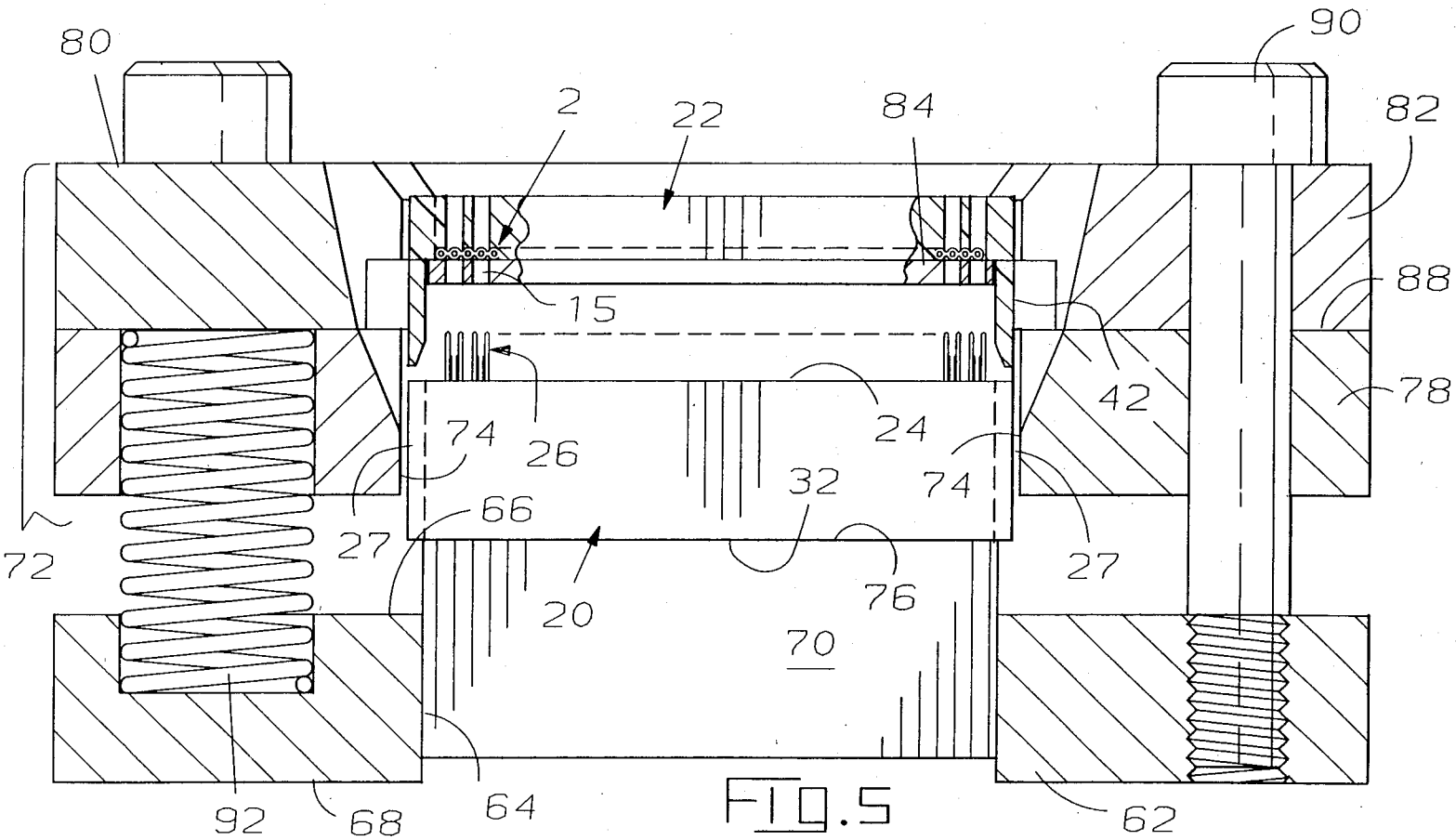
FIG. 5 is a cross sectional view of the apparatus with the connector and cable inserted therein, the apparatus is in its open or original position.
Figure 7:
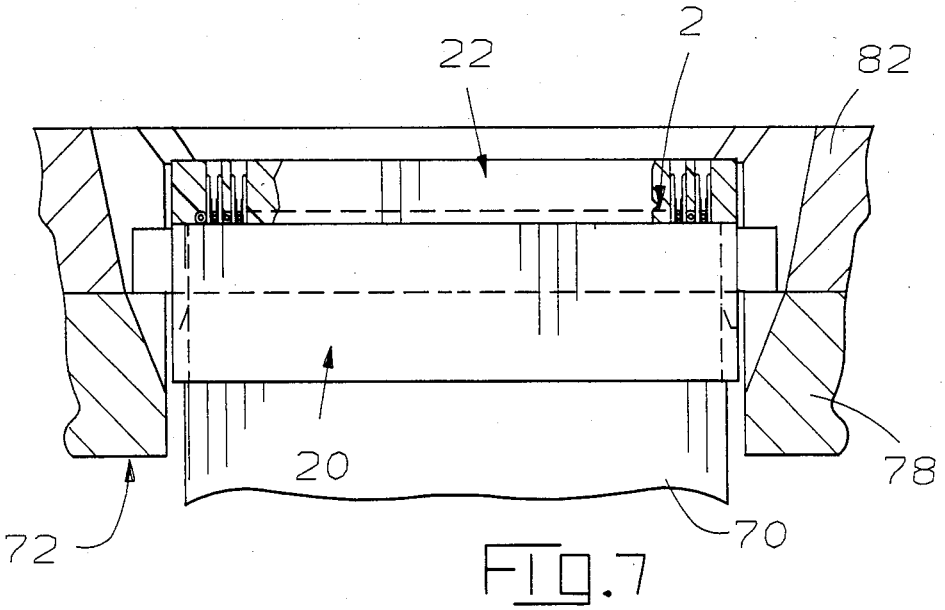
FIG. 7 is a cross sectional view similar to that of FIG. 5 showing the apparatus in a second and final closed position.

Positioned above base plate 62 and having essentially the same dimensions, is yoke portion 72. An opening 74 of yoke portion 72 aligns with opening 64 of base plate 62. The dimensions of opening 74 are slightly larger than the dimensions of opening 64, thereby allowing support block 70 to enter opening 74 as yoke portion 72 is moved from a first position, as shown in FIG. 5, to a second position, as shown in FIG. 7.

Figure 9:
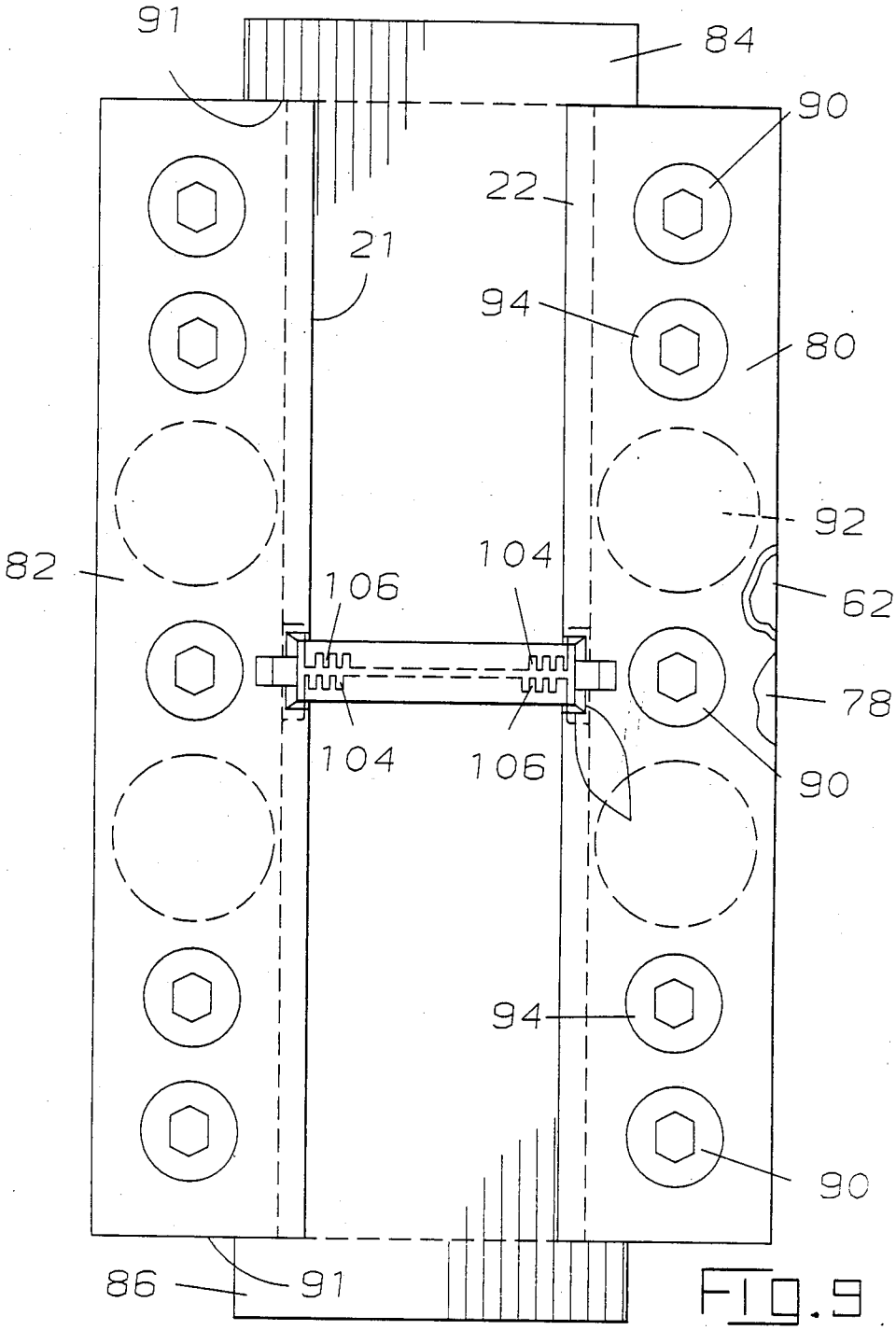
FIG. 9 is a top view of the apparatus.

As viewed in FIG. 1, yoke portion 72 comprises a guide plate 78, guide rails 80, 82, and camming guides 84, 86 (FIG. 9). As shown in FIG. 5, when yoke portion 72 is in the first position, guide plate 78 is provided proximate base plate 62.

Guide rails 80, 82 are secured to an upper surface 88 of guide plate 78 by screws 90. Camming guides 84, 86 are positioned between guide rails 80, 82, such that camming guides 84, 86 can move in the horizontal direction relative to guide plate 78 and guide rails 80, 82. Stop means 91 are provided at each end of yoke portion 72 to prevent camming guides 84, 86 from moving to far inward, harming terminals 26 of connector housing 20.

Yoke portion 72 is spring loaded and operates vertically as one unit. Four springs 92 springably connect yoke portion 72 to base plate 62, allowing yoke portion 72 to move relative to base plate 62 and also to provide the clamping pressure required for proper operation of apparatus 60, as will be discussed. Four socket head shoulder screws 94 (FIG. 9) accurately align guide rails 80, 82 with guide plate 78 and also serve as guide posts for yoke portion 72, securing yoke portion 72 to base plate 62. Yoke portion 72 is secured to base plate 62 by screws 94 which permit limited vertical motion of yoke portion 72 relative to base plate 62. Opening 74 of yoke portion 72 provides a nest 96 in guide plate 78 to precisely align connector housing 20 therein, and a nest 98 in guide rails 80, 82 to precisely align connector cover 22 therein.

As previously discussed, camming guides 84, 86 (best shown in FIG. 9) are movable in the horizontal direction. This movement causes ends 100, 102 to move into and out of opening 74 of yoke portion 72, as will be more fully discussed below. Ends 100, 102 are configured such that slots 104 are provided periodically and alternate with tongues 106. As shown in FIG. 9, slots 104 and tongues 106 of ends 100, 102 are aligned such that as ends 100, 102 are brought together, slots 104 of end 100 align with tongues 106 of end 102. Slots 104 of end 102 also align with tongues 106 of end 100. Slots 104 are precision ground to accurately align and guide terminals 26 of connector housing 20 into a proper termination position. Tongues 106 provide the pressure area to force conductors 4 of cable 2 into grooves 38 of cover member 22. These operations will be discussed more fully below. Ends 100, 102 of camming guides 84, 86 which have slots 104 and tongues 106 located thereon have a reduced thickness referred to as the blade thickness.

In order to fully understand the invention, it is important that the operation of apparatus 60 be discussed. Camming guides 84, 86 are opened, moved away from each other. This causes ends 100, 102 with tongues 106 and slots 104 positioned thereon, to be moved from opening 74. Connector housing 20 is inserted into opening 74. As can be seen from FIG. 5, connector housing 20 is slightly smaller than opening 74. Consequently, as connector housing 20 is inserted into opening 74, it falls through opening 74 until surface 32 engages surface 76 of support block 70. Connector housing 20 is thereby maintained in position in nest 96 of opening 74 of yoke portion 72. Camming guides 84, 86 are then closed such that tongues 106 of camming guide 84 are proximate but not overlapping tongues 106 of camming guide 86, as shown in FIG. 9. This positioning of ends 100, 102 of camming guides 84, 86 in opening 74, secures connector housing 20 in nest 96. Cable 2 is then laid on camming guides 84, 86 with sidewalls 108 of guide rails 80, 82 acting as an accurate locating means for cable 2. Sidewalls 108 are spaced such that the distance between them is slightly greater than the width of cable 2, thereby allowing cable 2 to be inserted between sidewalls 108. The sidewalls, however, are spaced to accurately maintain cable 2 in position. Cover member 22 is then positioned in opening 74 such that cover member 22 is positioned in nests 98 of guide rails 80, 82, accurately positioning cover member 22 in alignment with connector housing 20.

Figure 6:
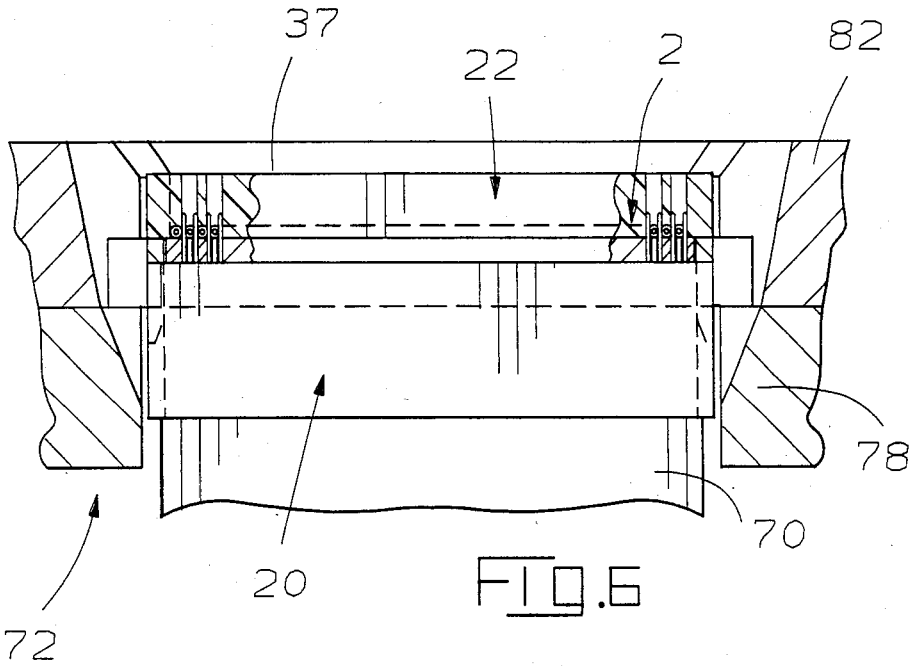
FIG. 6 is a cross sectional view similar to that of FIG. 5 showing the apparatus in a first closed position.

With connector housing 20, camming guides 84, 86, cable 2, and cover member 22 properly positioned, a force is applied to surface 37 of cover member 22 by an Arbor Press or similar device. This causes cover member 22 as well as yoke portion 72 to travel downward from the open position, as shown in FIG. 5, to the first closed position, as shown in FIG. 6. As this motion occurs, arms 42 of cover 22 engage recesses 43 of housing 20 to insure that cover 22 is properly aligned with housing 20. Next, tongues 106, in cooperation with cover member 22 firmly clamp cable 2 in position, forcing each respective conductor 4 into its proper respective groove 38 of cover member 22. As grooves 38 of cover member are accurately positioned with respect to terminals 26, the placement of conductors 4 in grooves 38 ensures that each conductor 4 is accurately positioned with respect to terminals 26. With conductors 4 accurately positioned, the downward motion continues, causing the sharp insulation piercing tips 30 of terminals 26 to enter slots 104 of camming guides 84, 86. Slots 104 guide terminals 26 to ensure that terminals 26 are precisely aligned with respective grooves 38 of cover member 22. Slots 104 also provide support to terminals 26, preventing from spreading as termination occurs, thereby allowing connectors with relatively weak terminal members to be terminated on the cable. Consequently, before terminals 26 are terminated onto conductors 4 of cable 2, both conductors 4 and terminals 26 have been accurately positioned, ensuring that proper termination will take place, thereby eliminating the possibility of misalignment of terminals 26 with conductors 4.

Downward motion is continued, forcing insulation piercing tips 30 to pierce the insulation of cable 2, until the first closed position is reached, as shown in FIG. 6. However, terminals 26 are not fully terminated to cable 2 at this time, terminals 26 are only partially terminated to cable 2. This termination is enough to frictionally connect terminals 26 to cable 2, as will be discussed. This completes the initial step of the termination process. This initial step is the heart of the termination process, as conductors 4 and terminals 26 have been positioned and partially terminated with the highest accuracy possible.

As the initial termination step is complete, the pressure applied to cover member 22 is withdrawn. This allows yoke portion 72, with cover member 22 thereon, to travel upward and stop at its original open position, as shown in FIG. 5. Since terminals 26 of connector housing 20 are partially terminated to cable 2 and cover member 22, terminals 26 and connector housing 20 must also move up. This movement leaves an opening between connector housing 20 and support block 70.

With yoke portion 72 in its open position and with connector housing hanging from cover member 22, camming guides 84, 86 are removed from between cover member 22 and connector housing 20, leaving a space therebetween. Support block 70 is then raised such that connector housing 20 will be forced upward relative to cover member 22, enabling complete termination of terminals 26 onto conductors 4, as shown in FIG. 7. It is important to note that support block 70 distributes forces evenly over the length of connector housing 20. This ensures that all terminals 26 will be terminated with equal force, thereby maximizing the probability of correct termination of each terminal 26 to respective conductors 4, producing a more reliable electrical connection. Shoulders 44 of terminals 26 cooperate with recesses 41 of cover member 22 to firmly maintain connector housing 20 in engagement with cover member 22.

The apparatus and method described ensure that the conductors of the cable and the terminals of the connector are accurately aligned with each other. This ensures that the connector will be properly terminated on the cable, even when the spacing between the center of the conductors is 0.025 inches. Consequently, an accurate and reliable electrical connection is assured, practically eliminating the possibility of shorting due to faulty termination of the conductors on the terminals.

I claim:

1. An apparatus for installing a multicontact electrical connector on a flat multiconductor cable, the connector having a housing means with terminals extending therefrom and a cover means with grooves therein, the cable having closely spaced conductors therein, the apparatus comprising:

a base plate having a top surface and a bottom surface, an opening provided in the base plate extending from the top surface to the bottom surface;

a yoke portion positioned adjacent the base plate and springably mounted thereto, such that the yoke portion is movable relative to the base plate, the yoke portion having a top surface and a bottom surface, an opening extending from the top surface to the bottom surface, the opening of the yoke portion being dimensioned to receive the connector housing means and cover means therein, the opening of the yoke portion being in alignment with the opening of the base plate;

a support block movable between a first position and a second position, the support block positioned in the opening of the base plate when the support block is in the first position;

connector cooperation means which can be moved in and out of the opening of the yoke portion as required, to allow the housing means to be inserted and maintained in proper position;

whereby the connector is accurately terminated to the cable as the yoke portion and support block are moved relative to the base plate.

2. An apparatus as recited in claim 1 wherein the yoke portion and the base plate have springs extending therebetween such that as a force is applied to the connector, the yoke portion is moved toward the base plate, as the force is removed the springs return the yoke portion to its original position.

3. An apparatus as recited in claim 1 wherein the openings provided in the yoke portion and the base plate are of the same dimensions, the dimensions being essentially equal to the dimensions of the connector, to allow the housing means and the cover means to be inserted therein, the openings ensuring that the housing means and the cover means are accurately aligned.

4. An apparatus as recited in claim 1 wherein the connector cooperation means are positioned at the ends of camming guides, the connector cooperation means being of reduced thickness relative to the remainder of the camming guides and comprising terminal cooperation slots and cable cooperation tongues, whereby as the housing means is terminated to the cable, the tongues cooperate with the conductors of the cable to ensure that the conductors are properly positioned in the grooves of the cover means and the slots cooperate with the terminals to accurately align the terminals and to prevent the terminals from spreading as the conductors of the cable are contacted.

5. An apparatus as recited in claim 4 wherein the tongues and the slots alternate on each respective end, the slots of one end align with the tongues of the other end.

6. An apparatus as recited in claim 4 wherein the yoke portion comprises the camming guides, a guide plate, and guide rails.

7. An apparatus as recited in claim 6 wherein the guide rails are secured to a top surface of the guide plate, one guide rail on either side of the opening of the yoke portion.

8. An apparatus as recited in claim 7 wherein the guide rails have recesses provided therein, the recesses aligning with the top surface of the guide plate to form a channel in which the side edges of the camming guides are positioned.

9. An apparatus as recited in claim 7 wherein socket head screws slidably secure the yoke portion to the base plate, such that, with the connector secured in place by the connector cooperation means, the yoke portion is forced toward the base plate, causing the terminals of the housing means to first, cooperate with slots of the camming guides, second to pierce the insulation of the conductors of the cable, and third to partially terminate to openings of the cover means, the force is then removed allowing the yoke portion to return to its original position, the housing means is forced to move with the yoke portion as the terminals of the housing means are frictionally engaged to the cover means.

10. An apparatus as recited in claim 9 wherein means is provided to move the support block from its first position to its second position, causing a top surface of the support block to contact a bottom surface of the housing means, forcing the terminals to fully terminate with the cover means.

11. An apparatus for accurately terminating a connector with terminals extending therefrom on a multiconductor cable, the connector having a housing means and a cover means, the apparatus comprising:

a base member having a top surface and a bottom surface, an opening provided in the base member extending from the top surface to the bottom surface;

yoke means movably mounted to the base member, an opening extending through the yoke means, the opening of the yoke means is positioned in alignment with the opening of the base member;

support means positioned in alignment with the opening of the base member and the opening of the yoke means, the support means being movable between a first position and a second position;

movable retention means which are positioned in the opening when the retention means are in a second position;

whereby as the yoke means, the support means, and the retention means are moved relative to the base member, the terminals of the housing means are terminated to the conductors of the cable and secured to the cover means.

12. An apparatus as recited in claim 11 wherein the yoke means has a guide plate, which has essentially the same dimensions as the base member, and guide rails mounted to a top surface of the guide plate, the guide rails being positioned on opposite sides of the opening of the yoke means.

13. An apparatus as recited in claim 11 wherein the support means is comprised of a support block, the support block being positioned in the opening of the base member when the support block is in the first position.

14. An apparatus as recited in claim 11 wherein the movable retention means is comprised of two camming guides which cooperate with channels in the yoke means, allowing the camming guides to be moved along a respective plane relative to the yoke means and maintained in position relative to yoke portion in all other planes of movement.

15. An apparatus as recited in claim 14 wherein the camming guides have ends which are of reduced thickness relative to the rest of the camming guides, the ends having slots and tongues positioned thereon.

16. An apparatus as recited in claim 15 wherein the slots and tongues of the camming guides alternate, the slots cooperating with the terminals of the connector and the tongues cooperating with the conductors of the cable.

17. An apparatus as recited in claim 11 wherein the yoke means and the base member have springs extending therebetween, such that as a force is applied to the connector, the yoke means is moved toward the base member, as the force is removed the springs return the yoke means to its original position.

18. An apparatus as recited in claim 11 wherein the openings provided in the yoke means and the base member are of the same dimensions, the dimensions being essentially equal to the dimensions of the connector, to allow the housing means and the cover means to be inserted therein, the openings ensuring that the housing means and the cover means are accurately aligned.

19. An apparatus as recited in claim 11 wherein socket head screws slidably secure the yoke means to the base member, such that, with the connector secured in place by the retention means, the yoke means is forced toward the base member, causing the terminals of the housing means to first, cooperate with slots of the retention means, second to pierce the insulation of the conductors of the cable, and third to partially terminate to openings of the cover means, the force is then removed allowing the yoke means to return to its original position, the housing means is forced to move with the yoke means as the terminals of the housing means are frictionally engaged to the cover means.

20. An alignment and termination apparatus for aligning and terminating a flat multiconductor cable to a multicontact connector, the cable comprising a plurality of side-by-side spaced-apart coplanar parallel conductors, the conductors being embedded in plastic insulating material and having axes which define a conductor plane, the cable having parallel side cable edges and oppositely-facing first and second major cable surfaces, each of the cable surfaces having, in transverse cross section, a series of cylindrical opposed and aligned convex projections with a conductor centrally located in the cable with respect to each pair of opposed projection, the spacing between the axes of adjacent conductors being $d \pm x$ where d is the nominal spacing and x is the spacing tolerance, the span distance between the two outside conductors, which are immediately adjacent to the side cable edges, being $(n-1)d \pm s$ where n is the number of conductors and s is the span tolerance, the span tolerance s being greater than the spacing tolerance x, the connector comprising a housing and a cover, the housing having a plurality of terminals, the cover having a plurality of grooves located on a surface thereof, respective grooves being in alignment with respective terminals, the apparatus being characterized in that:

the apparatus comprises first, second, and third tooling members, the first and the second tooling members having tool side edges and opposed first and second tool surfaces which extend between the tool side edges, the second tooling member being movable between an open and a closed position, the first and second tool surfaces being substantially against each other when the second tooling member is in the closed position and being spaced apart when the second tooling member is in the open position, the first and the second tooling members each having openings which are in alignment with each other, the third tooling member being positioned in the opening of the first tooling member such that the third member is movable between a first position and a second position, the second tooling member having means provided with are movable relative to the second tooling member, whereby the housing of the connector is placed into the opening of the second tooling member such that the a bottom surface of the housing engages a top surface of the third tooling member defining a stop position, the means are moved into the opening to secure the housing in place, the cable is then placed on the means in proper position, the cover is then positioned over the housing in the opening of second member, force is applied to the cover causing the cover to move toward the cable, causing means to force the conductors of the cable in the grooves of the cover, accurately positioning the conductors, as the force is continued the second tooling member moves toward the first tooling member, causing the terminals of the connector to cooperate with the means to ensure that terminals are properly partially terminated to the cable, the force is discontinued and the second tooling member returns to the open position, the means are removed from the opening and the third tooling member is forced toward the second tooling member causing the third tooling member to force the housing toward the cover completing the insertion of the terminals onto the cable.

21. A method of installing a multicontact connector on a flat multiconductor cable comprising the steps of:

aligning a cover member and a housing member of the connector in a spaced apart relationship;

positioning a cable support means between the cover member and the housing member;

placing the cable on a surface of the cable support means, such that the cover member, the cable, the cable support means, and the housing member are positioned in alignment with each other;

forcing the cover member toward the cable and the cable support means, the cable support means remaining stationary relative to the cover member, such that as the cover member contacts the cable, grooves provided on a surface of the cover member will cooperate with respective conductors of the cable, forcing the respective conductors into individual grooves of the cover member;

forcing the cover member, with the conductors of the cable positioned in the grooves, and the cable support member toward the housing member, causing terminals of the housing member to partially terminate with the respective conductors of the cable and with the cover member;

removing the cable support means from between the cable and the housing member; and forcing the housing member and the cover member together to complete the termination of the terminals to the respective conductors of the cable and to the cover member, thereby ensuring that a positive electrical connection has been affected between the connector and the cable.

* * * * *